US006126149A

United States Patent [19]

Holtzman

[11] Patent Number: 6,126,149

[45] Date of Patent: Oct. 3, 2000

[54] DYNAMIC PRESSURE SHIELD FOR CARBURETOR VENT SYSTEM

[76] Inventor: Barry L. Holtzman, 3907 Evergreen Rd., Eagle River, Wis. 54521

[21] Appl. No.: 09/186,762

[22] Filed: Nov. 5, 1998

[51] Int. Cl.[7] ..... F02M 5/08

[52] U.S. Cl. ..... 261/69.1; 261/DIG. 67

[58] Field of Search ..... 261/69.1, 69.2, 261/70, 72.1, DIG. 67, DIG. 68

[56] References Cited

U.S. PATENT DOCUMENTS

| | | | |
|---|---|---|---|
| 1,740,917 | 12/1929 | Beck | 261/72.1 |
| 2,023,647 | 12/1935 | Schmid | 261/DIG. 67 |
| 2,239,553 | 4/1941 | Dodson | 261/DIG. 67 |
| 3,789,812 | 2/1974 | Berry et al. | 261/DIG. 67 |
| 4,283,356 | 8/1981 | Arai et al. | 261/72.1 |
| 4,377,146 | 3/1983 | Oniki et al. | 261/DIG. 67 |
| 4,456,216 | 6/1984 | Boruta | 261/DIG. 67 |
| 4,499,032 | 2/1985 | Shibano | 261/DIG. 67 |
| 4,836,506 | 6/1989 | Hundertmark | 261/DIG. 67 |
| 5,021,198 | 6/1991 | Bostelmann | 261/72.1 X |
| 5,879,594 | 3/1999 | Holtzman | 261/39.2 |
| 5,879,595 | 3/1999 | Holtzman | 261/69.1 |

*Primary Examiner*—Richard L. Chiesa

[57] ABSTRACT

A fitting is installed on the vent system of a carburetor to shield the last opening of the vent system from dynamic pressures caused by wind currents around this opening. This fitting in its simplest form is a plastic tubing "T", which is installed in the end of the vent tubing of the carburetor. It has been found that this fitting is effective in reducing the dynamic pressure effects on the carburetor internal reference pressure. It has also been found that a "T" having a larger diameter cross hole than perpendicular hole is more effective in reducing the dynamic pressure effects on carburetor reference pressure.

3 Claims, 1 Drawing Sheet

DYNAMIC PRESSURE SHIELD FOR CARBURETOR VENT SYSTEM

BACKGROUND

1. Field of Invention

Figure 1:
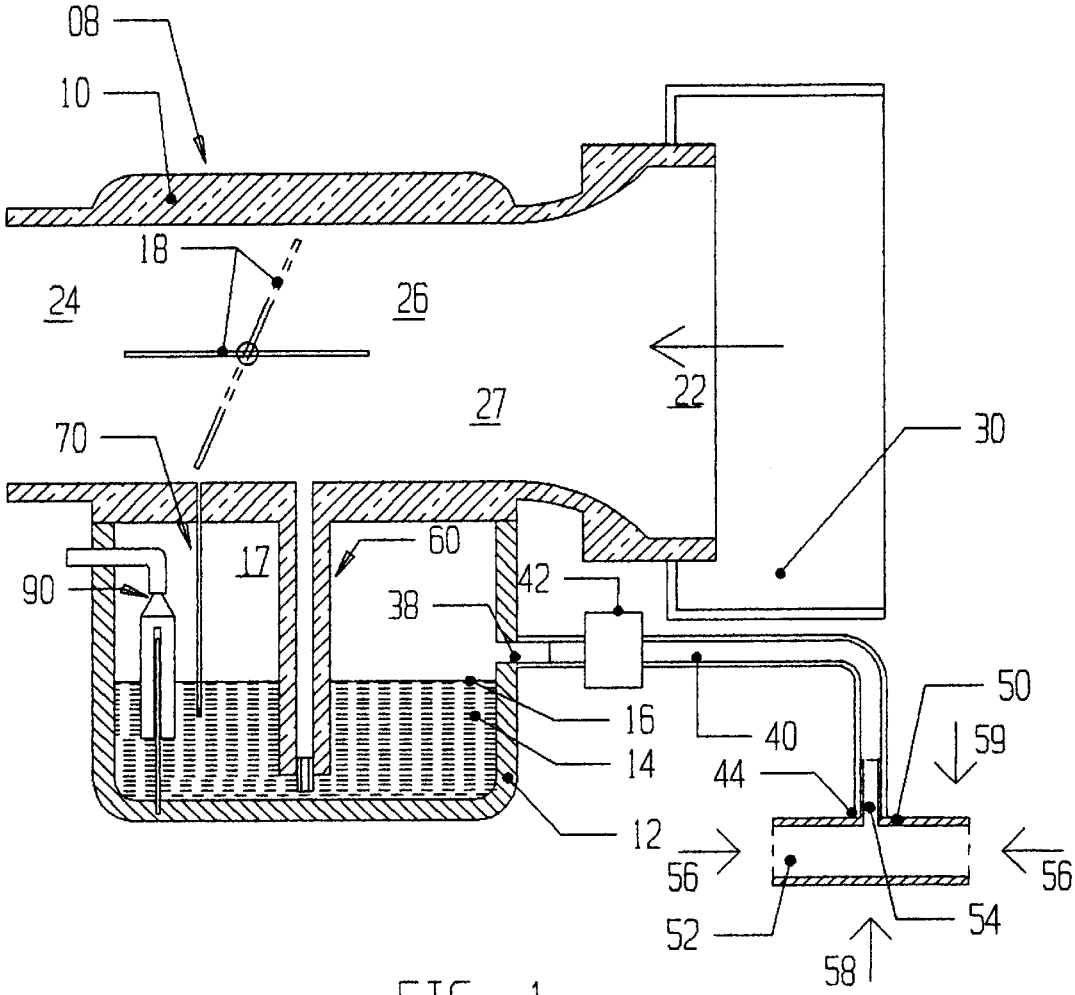

This invention is a fitting which effectively protects the vent openings of a carburetor from dynamic pressure caused by air currents which may exist around the carburetor. This fitting reduces the undesirable effect of this dynamic pressure on the fuel flow of the carburetor.

2. Description of Prior Art

Carburetors operate using air pressure differences acting to force fuel into a bore of the carburetor, and hence to an engine. This fuel flow is through one or more fuel metering orifices. Modern carburetors use multiple systems or circuits to provide the proper fuel/air ratio required for all engine operating parameters. These systems provide a balance between economy and power, enabling maximum power to be delivered by the engine upon demand, but maximum economy whenever possible.

Two basic elements determine the fuel flow in any of these various circuits. The first element is the physical size of the fuel metering orifice, and to a lesser extent, connecting passageways which comprise the particular fuel circuit. The metering orifice is usually sized to be considerably smaller than the other parts of the fuel delivery system, and for the purpose of analyzing fuel delivery, it can be assumed that the metering orifice constitutes the entire fuel delivery system. The second element is the pressure difference existing across the fuel delivery system, or essentially, the pressure existing across the metering orifice. For any given set of conditions, the fuel flow through the fuel delivery system varies approximately as the square root of this pressure difference.

The pressure difference acting across the fuel metering orifice, called the fuel driving pressure, in its most basic configuration consists of the pressure existing on the fuel in the fuel chamber of the carburetor, less the pressure existing in the carburetor bore where the outlet of the fuel delivery system is located, less the head pressure of the fuel, the distance the fuel must be raised from its level in the carburetor to the point at which it enters the bore. The pressure existing on the fuel in the fuel chamber is controlled by an average reference pressure established by a vent. If the vent is entirely external to the carburetor and its air induction passage, the venting is called external, and atmospheric pressure is the average reference pressure used for the carburetor. If the vent communicates with a region of the bore or other area of the air induction passage, for instance the air cleaner, this venting is called internal. In this case, the average reference pressure used for the carburetor will be slightly less than atmospheric, depending on the location of the pressure sensing end of the vent. Both types of venting, internal and external, are well known in the art.

Since the pressure internal to the carburetor, which is established by the venting system, is a factor in establishing the fuel driving pressure and hence fuel delivery rate, it is desirable to have this internal pressure maintained at a desired level, without influence by outside conditions such as wind currents.

There are two basic types of carburetors, float bowl carburetors and wet diaphragm carburetors. In a typical float bowl type carburetor, fuel flows from a larger fuel tank into the float bowl of the carburetor, the level of fuel in the float bowl being determined by a float-actuated valve. In this case, the venting system used, whether internal, external, or a combination of both, determines the pressure existing in the air occupying the space above the fuel internal to the carburetor. This pressure may contain pressure pulses due to fuel inlet valve instability or due to pressure pulses in the carburetor bore, but the average of this pressure is one parameter which determines average carburetor fuel delivery.

In a typical wet diaphragm type carburetor, fuel flows under pressure from the larger fuel tank to the carburetor, and the pressure internal to the carburetor is controlled by a diaphragm-operated valve. In this case, there is no fuel level specifically, as there is no void internal to the carburetor, it is completely filled with fuel. In this type carburetor, the dry side of the diaphragm, or the side of the diaphragm opposite the side in contact with the fuel, is housed in a chamber which is either internally or externally vented. The average pressure of this chamber, while not being the actual pressure existing on the fuel internal to the carburetor, is the average reference pressure which determines the fuel pressure internal to the carburetor. This average reference pressure exists on the dry side of the diaphragm, while the fuel pressure internal to the carburetor exists on the wet side of the diaphragm. The movement of this diaphragm positions the moveable member of an inlet valve, and hence regulates the average fuel pressure in the carburetor and therefore helps determine average carburetor fuel delivery.

Prior art has discussed how changes in internal carburetor reference pressure will change the flow of fuel to an engine. U.S. Pat. No. 1,740,917 to Beck (1926) uses an internal vent orifice in the carburetor bore which has its pressure affected by the throttle position. This internal vent, used in conjunction with a throttled bleed to the outside atmosphere, determines the internal pressure in the carburetor, thus affecting fuel flow. U.S. Pat. No. 5,021,198 to Bostelman (1990) describes a carburetor altitude compensation system using a pressure splitter to regulate the fuel flow through the carburetors. In this system, a sealed metering chamber and diaphragm is used to position a valve (choke), which changes the intermediate pressure existing between two orifices. One orifice is located in the line from the venturi region of the carburetor bore, providing a vacuum which tends to decrease the flow of fuel. The other orifice is in the line connected to a region of essentially atmospheric pressure, for instance the air cleaner. This line tends to establish the float bowl pressure at atmospheric pressure, at which maximum fuel flow will occur. The movement of the diaphragm causes a change in the relative size of the two orifices, therefore causing a change in the intermediate pressure existing between the two orifices. This intermediate pressure is applied to the carburetor and is the carburetor reference pressure, and fuel flow varies as the reference pressure varies.

In my co-pending application 08/846815, filed on Apr. 30, 1997 and now U.S. Pat. No. 5,879,595, I describe a carburetor fuel flow regulator which affects the fuel flow by varying the carburetor reference pressure. This regulator uses a moveable member which changes gas flow speed parallel to an orifice, thereby affecting the static pressure existing in the orifice, and this variable pressure determines the carburetor reference pressure and hence fuel flow. In my co-pending application 08/891433, filed on Jul. 10, 1997 and now U.S. Pat. No. 5,879,594, a temperature controlled pressure splitter is used to modify carburetor reference pressure and fuel flow.

None of the above mentioned references disclose the effect of dynamic pressure existing at the carburetor vent opening and the effect this dynamic pressure will have on carburetor fuel flow. This dynamic pressure is caused by wind currents which are likely to exist under the hood, and hence around the carburetor, of any moving vehicle.

OBJECTS AND ADVANTAGES

It is an object of this invention to provide a low cost, easily applied, fitting which protects the vent system of a carburetor from dynamic pressure which may exist around the carburetor. Protecting the carburetor vent system from this dynamic pressure will result in more uniform fuel flow, improving performance and fuel economy.

Still further objects and advantages will become apparent from a consideration of the ensuing description and drawings.

DRAWING FIGURES

FIG. 1 shows a cross sectional view from the side of a float bowl type carburetor taken in a plane coinciding with the axis of the carburetor, having a dynamic pressure shield fitting attached to the last opening of the vent system of the carburetor.

REFERENCE NUMERALS IN DRAWINGS

08 float bowl carburetor assembly
10 float bowl carburetor body
12 float bowl
14 fuel
16 fuel level
17 float bowl air chamber
18 butterfly throttle valve
22 air inlet or bell
24 air/fuel outlet
26 throat
27 main bore
30 air filter
38 vent hole
40 vent/air chamber connecting conduit
42 vent pressure modification system
44 last opening in vent system
50 dynamic pressure shield fitting
52 cross conduit
54 static pressure conduit
56 direction of dynamic pressure parallel with axis of cross conduit
58 direction of dynamic pressure directed toward vent conduit opening
59 direction of dynamic pressure directed away from vent conduit opening
60 high speed fuel delivery system
70 low speed fuel delivery system
90 float bowl fuel inlet assembly

DESCRIPTION AND OPERATION—FIG. 1

FIG. 1 shows a float bowl carburetor assembly 08 with a dynamic pressure shield fitting 50 installed in accordance with this invention. Carburetor body 10 is usually cast and then machined to provide all the drillings, tapped holes, and smoothing required for its proper operation. A float bowl 12 is attached to body 10 usually with screws and a sealing gasket, not shown. Fuel entry into the carburetor is controlled by a fuel inlet assembly 90, fuel 14 being allowed to enter carburetor until a predetermined fuel level 16 is attained. Chamber 17 is the air space above the fuel level. A butterfly throttle valve 18 is controlled by an accelerator linkage, not shown. Air enters the carburetor through an air filter 30, entering at air inlet or bell 22; a mixture of air and fuel exit at outlet 24. The entire drilling from bell 22 to outlet 24 is main bore 27. The part of 27 having the smallest cross sectional area is throat 26. A high speed fuel delivery system 60 and low speed fuel delivery system 70 provide fuel to main bore 27.

Chamber 17 is connected to some external air volume through vent hole 38. Conduit 40 is normally a plastic tube attached to hole 38. Sometimes a vent pressure modification system 42 is used to operationally affect the reference pressure in chamber 17 and hence the fuel flow through the carburetor. The last opening of the vent system, opening 44, is normally left open to the atmosphere. Air currents around opening 44 will cause dynamic pressure to exist, one direction of this dynamic pressure component being shown by arrows 56 (the two directions of course in this case are operationally equivalent) in a direction parallel to opening 44. Arrow 59 is a direction for dynamic pressure directed out of opening 44, arrow 58 being a direction for dynamic pressure being directed into opening 44.

If dynamic pressure shield fitting 50 is not installed to end of conduit 40, dynamic pressure (wind current) in a direction shown by arrow 58 will cause an increase in pressure in chamber 17 above the static pressure existing at the end of conduit 40, causing an undesirable increase in fuel flow. Dynamic pressures in the directions of arrows 56 and 59 will cause no such increase in chamber 17 pressure.

If fitting 50 is installed to conduit 40, dynamic pressures in the direction of arrow 58 will cause no increase in pressure in chamber 17, dynamic pressure in the direction of arrow 59 will still have no effect on chamber 17 pressure, and dynamic pressure in the direction of arrows 56 has been shown to cause only a small increase in chamber 17 pressure.

The above results were tested as follows. A typical float bowl type carburetor was used in a test having two vent holes 38, one vent hole being attached to a sensitive manometer, and thus used to monitor chamber 17 pressure above atmospheric. The other hole had a conduit 40 attached consisting of 40 cm (16") of 4 mm (5/32") inside diameter plastic tubing.

Chamber 17 was completely sealed except for these two holes 38. An air source was used which provided a dynamic pressure of 0.38 cm (0.15") of water pressure, corresponding to an air velocity of 27 cm/sec (16 miles per hour). This air velocity (dynamic pressure) was directed against the open end of conduit 40, opening 44, corresponding to a direction indicated by arrow 58. The manometer indicated a pressure in chamber 17 of 0.38 cm (0.15") of water, the same as the dynamic pressure applied to opening 44. A typical venturi vacuum is 12.7 cm (5") of water with a fuel head pressure of 1.3 cm (0.5") of water. Using these figures, this 27 cm/sec (16 miles per hour) wind would increase the fuel flow in the carburetor approximately 1.5%. When the air source was in the direction of arrows 56 and 59, no deflection of the manometer was observed.

A dynamic pressure shield fitting was installed in accordance with this invention. The first fitting used was a "T" used for 4 mm (5/32") plastic tubing sold by Ark-Plas Products of Flippin, Ark., item number 0416TEE. This fitting has equal cross conduit and static pressure sensing conduit internal diameters of 0.25 cm (0.1"). With this fitting installed on conduit 40, dynamic pressure in the direction indicated by arrow 58 of 0.38 cm (0.15") of water resulted in no observable increase in chamber 17 pressure. With the same dynamic pressure magnitude in the direction of arrows

56, chamber pressure only increased by 0.1 cm (0.04") of water, much less than the dynamic pressure magnitude of 0.38 cm (0.15") of water.

Another dynamic pressure shield fitting 50 was used being manufactured by the same manufacturer above as item number 0416T12. This "T" has the same cross conduit internal diameter as above, 0.25 cm (0.1"), but a smaller static pressure conduit internal diameter of 0.2 cm (0.078"). Again, with the same dynamic pressure in the direction of arrow 58, no increase in chamber pressure 17 was observed. With 0.38 cm (0.15") of dynamic pressure in the direction of arrow 56, the increase in pressure in chamber 17 was observed to be only 0.05 cm (0.02") of water.

Summary, Ramification, and Scope

Accordingly, the reader will see that this invention provides a dynamic pressure shield for the last opening(s) in a carburetor vent system which is low in cost, easily installed, and effective in minimizing fuel flow fluctuation caused by wind currents which exist around a carburetor. Also, it has been shown how a readily available plastic tubing "T" can perform this function, and furthermore how a readily available plastic tubing "T" with unequal leg diameters can be used to improve the operation of this shield.

Although the description above contains many specificities, these should not be construed as limiting the scope of the invention but as merely providing illustrations of some of the presently preferred embodiments of this invention. Thus the scope of the invention should be determined by the appended claims and their legal equivalents, rather than by the examples given.

What is claimed is:

1. A fitting used in the vent system of a carburetor, said carburetor having an internal pressure and an external pressure, said internal pressure and said external pressure having a relationship established by said vent system, said fitting containing first and second openings sensing said external pressure, said fitting containing a third opening sensing said internal pressure, said first and second openings having communication through a conduit and said third opening having communication with said conduit, said external pressure containing an external dynamic pressure component with a direction, said first opening being optimally effective in sensing said external dynamic pressure in a first direction, said second opening being optimally effective in sensing said external dynamic pressure in a second direction, said first direction and said second direction being operationally different, said third opening being ineffective in sensing dynamic pressure in said conduit, whereby the effect of said external dynamic pressure component with any said direction on said third opening is reduced thereby reducing the effect of said external dynamic pressure on said internal pressure of said carburetor.

2. The fitting of claim 1 wherein said first direction and said second direction are essentially opposite.

3. The fitting of claim 1 in which said conduit has an area in cross section larger than the area of said third opening.

* * * * *